US006054663A

United States Patent [19]

Cranick et al.

[11] Patent Number: 6,054,663

[45] Date of Patent: Apr. 25, 2000

[54] MODULAR SWITCH

[75] Inventors: John Cranick, White Lake; Boris Karasik, Walled Lake, both of Mich.

[73] Assignee: Lear Automotive Dearborn, Inc., Southfield, Mich.

[21] Appl. No.: 09/118,772

[22] Filed: Jul. 18, 1998

[51] Int. Cl.[7] ..... H01H 3/02

[52] U.S. Cl. ..... 200/338; 200/332; 200/337

[58] Field of Search ..... 200/339, 332, 200/335, 338, 330, 16 R

[56] References Cited

U.S. PATENT DOCUMENTS

| | | | |
|---|---|---|---|
| 2,479,462 | 8/1949 | Bentley | 200/547 X |
| 4,121,072 | 10/1978 | Hults | 200/438 X |
| 4,376,234 | 3/1983 | Liataud et al. | 200/16 R |
| 4,816,631 | 3/1989 | Yamashita et al. | 200/332 |
| 5,555,973 | 9/1996 | Horisawa | 200/339 X |

*Primary Examiner*—Renee S. Luebke
*Attorney, Agent, or Firm*—Brooks & Kushman P.C.

[57] ABSTRACT

A user-activated modular switch assembly includes an actuator assembly slidable between a first position and a second position on a housing. A static knob or a rocking knob is selectively mounted to the actuator assembly to provide either conventional slide actuation or rocking activation of the switch. The actuator assembly configuration includes integral mounting members allowing for the direct mounting of either knob type.

1 Claim, 2 Drawing Sheets

MODULAR SWITCH

BACKGROUND OF THE INVENTION

The present invention relates generally to a user-activated switch and more particularly to a user-activated switch assembly which can be assembled in different configurations to provide rocker or slide actuation.

Current switch assemblies are typically activated by either a rocking or a sliding motion. A rocker knob is pivotally mounted to a housing and pivotally moveable, typically from a neutral center position to either a rearward position or a forward position. Similarly, a sliding switch is slidably mounted to a housing and slidably moveable from a neutral center position to either a rearward position or a forward position. A first set of contacts are closed when the switch is in the forward position and a second set of contacts are closed when the switch is in the rearward position. Typically, one of a plurality of known return features are provided.

Currently different switches must be produced to provide either sliding or rocking actuation. This increases tooling costs for the hardware, the amount of inventory which must be maintained, the assembly time required to select, retrieve, and install the proper hardware, and the overall cost.

SUMMARY OF THE INVENTION

The present invention provides a modular switch assembly which provides either sliding or rocking configuration while maintaining many common components. The switch assembly generally comprises an actuation assembly, selectably slidable among a forward position, a neutral position and a rearward position in a housing. Either a rocking knob or a shaft knob is directly mounted to the actuation assembly. The first configuration includes the shaft knob attached to the actuator assembly to directly slide the actuator assembly between the forward position, the neutral position and the rearward position. The second configuration includes a rocker knob which is pivotally mounted for providing a pivotal motion on to the actuator assembly. The actuator assembly translates pivotal actuation motion of the rocker knob to actuator assembly sliding motion. In each configuration the sliding motion of the actuator assembly is the same.

Preferably, the projections are integrally molded to the actuator assembly for the mounting of the rocker knob. The rocker knob defines first and second axes perpendicular to movement of the sliding actuator assembly. The first axis is defined by pivot posts on the rocker knob in which the rocker knob pivots upon actuation. The second axis is defined by slots in the rocker knob which travel in an arcuate motion as the rocker knob pivots on the first axis. The slots receive the actuator assembly projections and translate the arcuate motion of the slots into sliding movement of the actuator assembly. Thus, either knob can be mounted to the identical sliding actuator assembly to provide two different switches each having different actuation buttons.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF A PREFERRED EMBODIMENT

Figure 1:
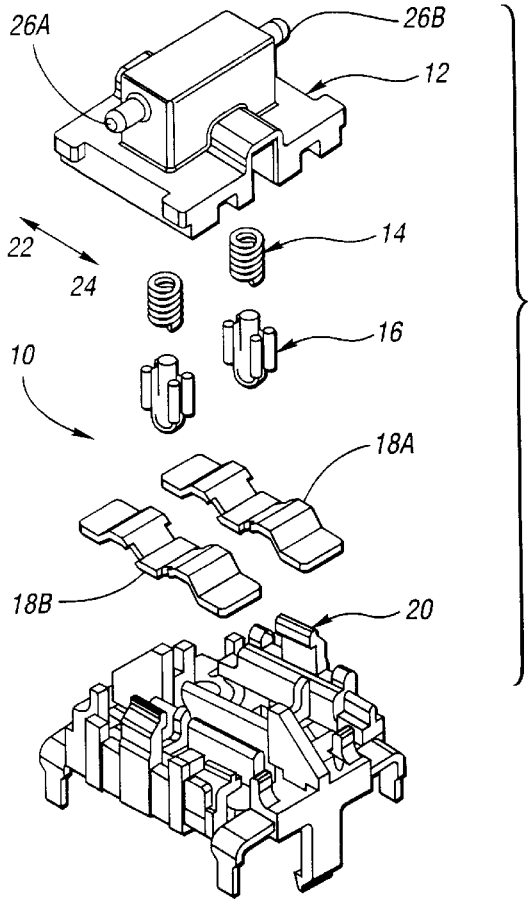
FIG. 1 is an exploded view of the switch assembly of the present invention.

A modular switch assembly 10 according to the present invention is shown in FIG. 1. An actuator assembly 12 is slidably mounted to a circuit plate housing 20. The switch assembly 10 generally comprises an actuation assembly 12, selectably slidable in the direction of arrows 22, 24 typically among a forward position, a neutral position, and a rearward position in the circuit plate housing 20. A spring 14 is provided for biasing a plunger 16 downwardly. The spring 14 and plunger 16 are selected to fit within actuator assembly 12.

The actuator assembly 12 slides to selectively activate electrical contact between contactors 18A, 18B with contacts on the circuit plate housing 20, thereby actuating the electrical functions controlled by switch assembly 10. Those skilled in the art shall realize that other arrangements of contactors 18A, 18B may also be utilized. Typically, a first electrical function is activated when the actuator assembly 12 slides in a forward or first direction to bring contactor 18A into contact with a contact on the circuit plate housing 20. A second electrical function is further activated when the actuator assembly 12 slides in a rearward or second direction to bring contactor 18B into contact with a contact on the circuit plate housing 20. Of course, the terms "forward" and "rearward" are utilized herein only for convenience. It should be apparent that the switch assembly 10 can be mounted in any orientation and any combination of electrical functions may be made available.

Figure 2:
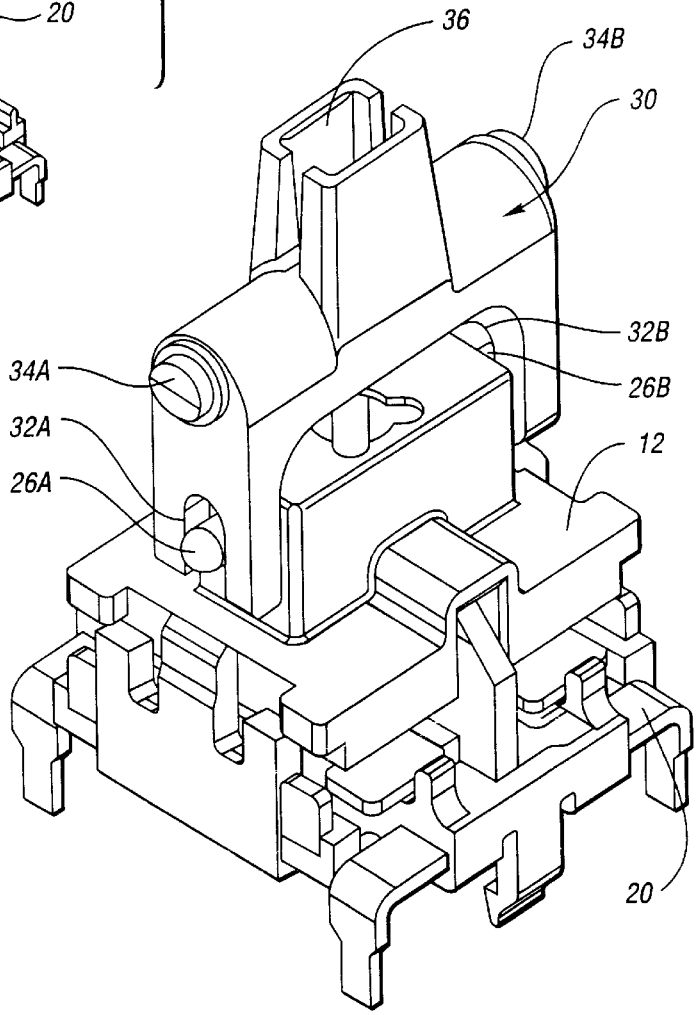
FIG. 2 is a perspective view of the switch assembly of FIG. 1 in a first configuration.

FIG. 2 shows a perspective view of the modular switch assembly 10 of the present invention configured with a rocker knob 30. The rocker-style knob 30 is pivotally mounted for providing a pivotal motion. Preferably, projections 26A,26B of the actuator assembly 12 are located in apertures 32A,32B and are oriented perpendicular to the slidable movement of actuator assembly 12. Pivot posts 34A,34B provides pivotal mounting of the rocker knob 30 in an external structure such as window or seat control panels of a vehicle. Mounting post 36 allows attachment of an actuation button (not shown) for the designated function.

As can be seen in FIG. 2, the rocker knob 30 pivots on a first axis defined by pivot posts 34A and 34B in response to an operation of the actuator button. Pivoting of rocker knob 30 causes the slots 32A,32B to move in an arcuate motion about the first axis. The projections 26A,26B are retained within slots 32A,32B during the arcuate motion of the slots 32A,32B. Slots 32A and 32B thereby act on projections 26A,26B to translate the rotational movement of rocker knob 30 into sliding movement of actuator assembly 12 to cause contactors 18A, 18B to make electrical contact to activate different functions.

Figure 3:
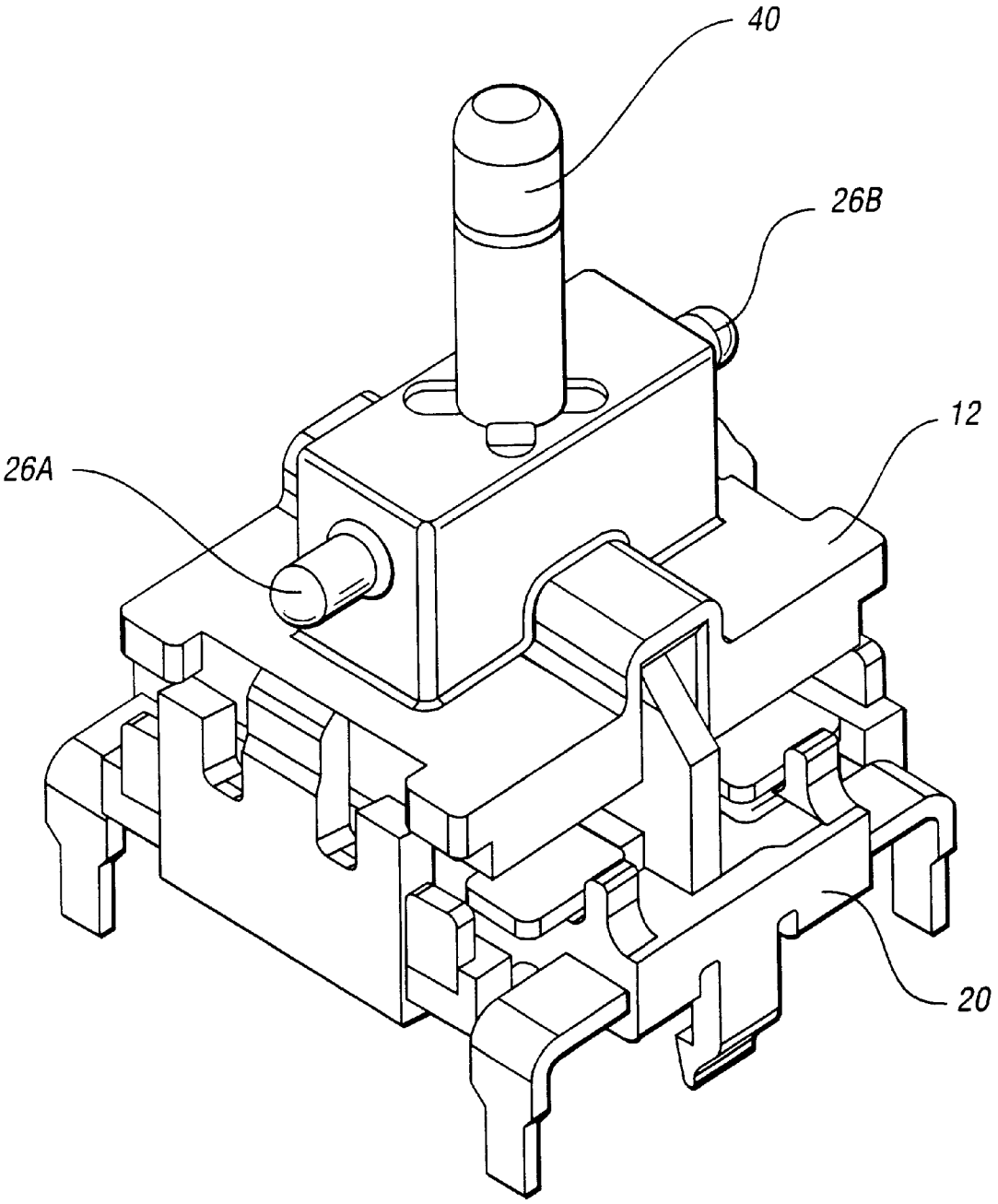
FIG. 3 is a perspective view of the switch assembly of FIG. 1 in a second configuration.

The switch assembly 10 may also be configured for direct, linear slidable actuation as shown in FIG. 3. In some cases it is preferable to operate a switch in a direct, linear forward and rearward manner. Again, it should be apparent that the terms "forward" and "rearward" are utilized only with respect to the drawings. FIG. 3 shows the basic switch assembly 10 as shown in FIG. 1. In this configuration, the rocker knob 30 is replaced by a mounting post 40. The mounting post 40 allows attachment of an actuation button (not shown) for the designated function. Mounting post 40 is attached to actuator assembly 12 to directly slide the actuator assembly relative to circuit plate housing 20 from a first, middle position to a forward position or rearward position to make electrical contact between contactors 18A, 18B and the contact on the circuit plate housing 20. It is a feature of the present invention that the actuator assembly 12 operates in the same manner irrespective of which knob combination is selected.

In accordance with the provisions of the patent statutes, the present invention has been described in what is considered to represent a preferred embodiment. However, it should be noted that the invention can be practiced otherwise than as specifically illustrated and described without departing from its spirit or scope.

What is claimed is:

1. A user-activated modular switch assembly comprising:

a housing;

first and second contacts;

an actuator assembly linearly slidable between a first position and a second position on said housing, said actuator assembly actuating a first contactor for contacting said first contact when said actuator assembly is in said first position and actuating a second contactor for contacting said second contact when said actuator assembly is in said second position;

said actuator assembly assembled in either a first configuration having a shaft knob attached to said actuator assembly to directly slide said actuator assembly between said first position and said second position, or a second configuration having a rocker knob pivotally mounted for providing pivotal motion on said actuator assembly, said actuator assembly translating pivotal motion of said rocker knob to sliding motion of said actuator assembly between said first position and said second position, wherein said rocker knob includes first and second axes perpendicular to movement of said actuator assembly, said rocker knob pivotable on said first axis and said second axis traveling in an arcuate motion as said rocker knob pivots, said actuator assembly including an integral projection perpendicular to movement of said actuator assembly, said rocker knob including a slot for receipt of said integral projection to translate said arcuate motion as said rocker knob pivots into sliding motion of said actuator assembly, wherein said actuator assembly in the first and second configurations has identical sliding movements, and wherein the shaft knob and the rocker knob are not attached simultaneously.

* * * * *